US008720917B1

(12) United States Patent
Gair

(10) Patent No.: US 8,720,917 B1
(45) Date of Patent: May 13, 2014

(54) SKATEBOARD ACCESSORY FOR PERFORMING OLLIE MANEUVER

(71) Applicant: Frank Gair, Williamsport, PA (US)

(72) Inventor: Frank Gair, Williamsport, PA (US)

( * ) Notice: Subject to any disclaimer, the term of this patent is extended or adjusted under 35 U.S.C. 154(b) by 0 days.

(21) Appl. No.: 13/924,727

(22) Filed: Jun. 24, 2013

Related U.S. Application Data

(60) Provisional application No. 61/666,410, filed on Jun. 29, 2012.

(51) Int. Cl.
*A63C 17/26* (2006.01)

(52) U.S. Cl.
CPC ..... *A63C 17/26* (2013.01)
USPC ..... 280/87.042; 280/11.27

(58) Field of Classification Search
CPC .... A63C 17/00; A63C 17/0046; A63C 17/01; A63C 17/26; A63C 2201/02
USPC ..... 280/87.01, 87.021, 87.03, 87.041, 280/87.042, 11.27, 11.28
See application file for complete search history.

(56) References Cited

U.S. PATENT DOCUMENTS

| | | | | |
|---|---|---|---|---|
| 4,040,639 | A | 8/1977 | Scardenzan | |
| 4,351,538 | A * | 9/1982 | Berta | 280/11.26 |
| 5,221,111 | A | 6/1993 | Younger | |
| 6,213,484 | B1 | 4/2001 | Rohner | |
| 6,527,284 | B2 | 3/2003 | Bert | |
| 6,793,224 | B2 | 9/2004 | Stratton | |
| 7,243,925 | B2 | 7/2007 | Lukoszek | |
| 7,287,762 | B2 | 10/2007 | Stratton | |
| 7,628,412 | B2 | 12/2009 | Colon | |
| 8,100,420 | B2 | 1/2012 | Sentagnes | |
| 8,398,100 | B2 * | 3/2013 | Tedla | 280/87.042 |
| 2005/0051983 | A1 | 3/2005 | Williams | |
| 2011/0210526 | A1 | 9/2011 | Williams, Jr. | |
| 2012/0139203 | A1 | 6/2012 | Tedla | |

* cited by examiner

*Primary Examiner* — John Walters
(74) *Attorney, Agent, or Firm* — Wendy W. Koba

(57) ABSTRACT

A spring-loaded skateboard accessory is configured to assist a rider in the performance of an ollie maneuver. The accessory includes a mounting plate for attaching the accessory to a skateboard truck, a rotatable kick plate assembly and a spring component coupled between the mounting plate and the rotatable kick plate. The spring component compresses as the kick plate assembly contacts the ground during the beginning of an ollie maneuver. As the rider forces the board off the ground, the tension in the spring is released and provides energy to provide increased lift ("air") to a skateboard maneuver.

14 Claims, 6 Drawing Sheets

SKATEBOARD ACCESSORY FOR PERFORMING OLLIE MANEUVER

CROSS-REFERENCE TO RELATED APPLICATIONS

This application claims the benefit of U.S. Provisional Application Ser. No. 61/666,410, filed Jun. 29, 2012, which is incorporated herein by reference.

TECHNICAL FIELD

The present invention relates to a skateboard accessory and, more particularly, to a spring-loaded kick plate accessory that can be attached to a skateboard axle and used to improve the performance of certain maneuvers.

BACKGROUND OF THE INVENTION

A skateboard is generally constituted of a board ("deck") beneath which two devices for holding axles are fixed. Generally, each of these holding devices is directional, and the axle which they hold supports two wheels. Such devices for directional holding of an axle are commonly referred to as "trucks". The trucks make it possible to control the direction of the skateboard as the skateboard rider has both feet positioned on the deck and moves the board by rolling. The control of the direction is carried out by shifting the skater's weight to one side of the board or the other.

Skateboarding has changed dramatically over the years. In the late 1980s, the maneuver known as an "ollie" was developed and evolved to become the foundation of the modern sport. Essentially every skateboard maneuver used today is initiated with an ollie. An ollie enables the rider (and board) to become airborne so as to execute acrobatic maneuvers or clear obstacles. A rider begins the ollie maneuver by crouching and jumping directly upward. As the rider jumps up, he "pops" the tail of the board by striking it against the ground, which raises the board "nose-first" off of the ground. Maintaining contact with the board while airborne, the rider lifts his front leg and bends his ankle so that the outer/top side of his shoe slides toward the nose of the board. The friction between the shoe and the upper surface of the board helps to guide and pull the board upward, while the rear foot maintains only minimal contact with the board (for guiding purposes). The degree of energy transfer from the rider to the board is central to the successful execution of the ollie. Riders attempting to achieve record-setting heights are known to contort their legs and feet into awkward positions in order to gain more "air".

For some, the basic mechanics of learning the ollie maneuver are difficult to grasp. Discouraged, some riders give up attempting to improve their skills. Thus, a need remains for some type of skateboard that allows for beginning riders (among others) to successfully perform the ollie maneuver.

SUMMARY OF THE INVENTION

The present invention addresses the needs remaining in the art and, more particularly, relates to a skateboard accessory in the form of one or more spring-loaded kick plates that can be attached to a skateboard truck and used to improve the performance of certain maneuvers.

In one embodiment of the present invention, a spring-loaded skateboard accessory is configured to assist a rider in the performance of an ollie maneuver. The accessory includes a mounting plate for attaching the accessory to a skateboard truck, a kick plate assembly and a spring component coupled between the mounting plate and the kick plate. As a rider initiates an ollie maneuver by striking the end of the board against the ground, the kick plate contacts ground and compresses the attached spring component. As the board begins to lift off the ground, the tension in the spring is released and provides energy that increases lift ("air") to a skateboard maneuver.

A spring-loaded skateboard accessory of the present invention can be formed with a single kick plate, or a pair of kick plates positioned next to each other. In one embodiment of the inventive accessory, torsion springs are used to attach the kick plate(s) to the skateboard truck. In an alternative embodiment, a vertical spring can be used, which provides a reaction similar to a pogo stick to the end of the skateboard.

The skateboard accessory of the present invention may be an individual component, sold separately from a skateboard and thereafter attached to the skateboard truck by the rider. Alternatively, a skateboard may be manufactured to include the spring-loaded accessory as part of the original assembly.

These and other features and embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

The present invention relates to an accessory that may be attached to the underside of a skateboard and used to provide a greater "lift" during an ollie. The accessory can be thought of as a training device that helps a new rider learn how to perform an ollie. Alternatively, the accessory may be particularly configured, as described below, to provide a large spring action to the ollie maneuver, allowing for a seasoned rider to achieve a higher lift and thus perform even more complicated tricks. The accessory may be incorporated into the truck portion of a skateboard and thus sold as part of the original equipment. Alternatively, the accessory may be sold separately and attached to the truck by the rider. As also discussed below, the accessory may be attached at various, different locations between the hanger (axle) and baseplate of the skateboard.

Figure 1:
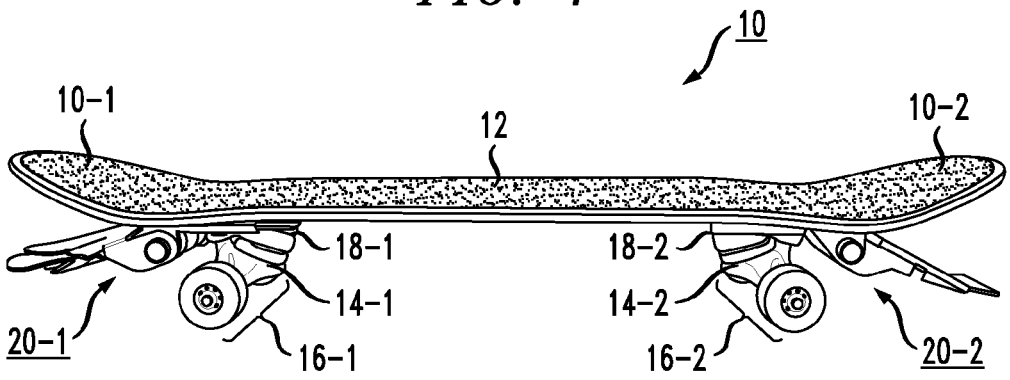
FIG. 1 is a side view of a conventional skateboard that is equipped with a pair of spring-loaded ollie accessories formed in accordance with the present invention.

FIG. 1 is a side view of a conventional skateboard 10 incorporating a pair of spring-loaded ollie accessories 20-1 and 20-2 formed in accordance with the present invention. Skateboard 10 is shown as including a deck 12 and a pair of axles 14-1, 14-2 mounted to the underside of deck 12 near opposing ends 10-1 and 10-2 of skateboard 10. A pair of wheels 16-1 and 16-2 is shown as mounted on axles 14-1 and 14-2, respectively. Each axle and its mounting bracket as defined as components of each skateboard truck 18-1 and 18-2. (axle 14 being part of a "truck" 18).

In accordance with the present invention, when a rider begins an ollie maneuver, one of the spring-loaded ollie accessories (for example, accessory 20-1 will strike the ground. As will be described in detail below, the kick plate of accessory 20-1 is attached to a spring that compresses during the time, where the spring then relaxes as board 10 rises into the air, providing additional lift to the rider.

Figure 2:
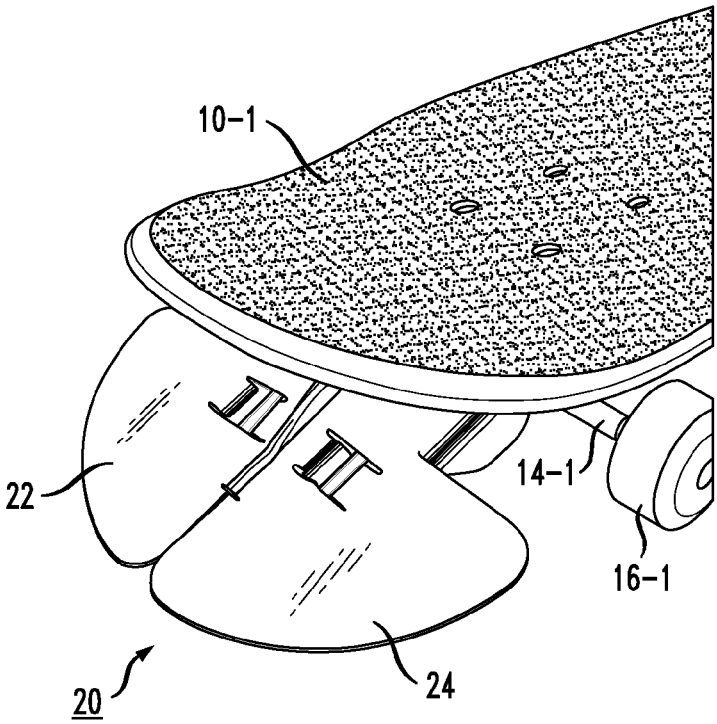
FIG. 2 illustrates an end portion of the skateboard of FIG. 1, illustrating a two-piece kick plate ollie accessory.
Figure 3:
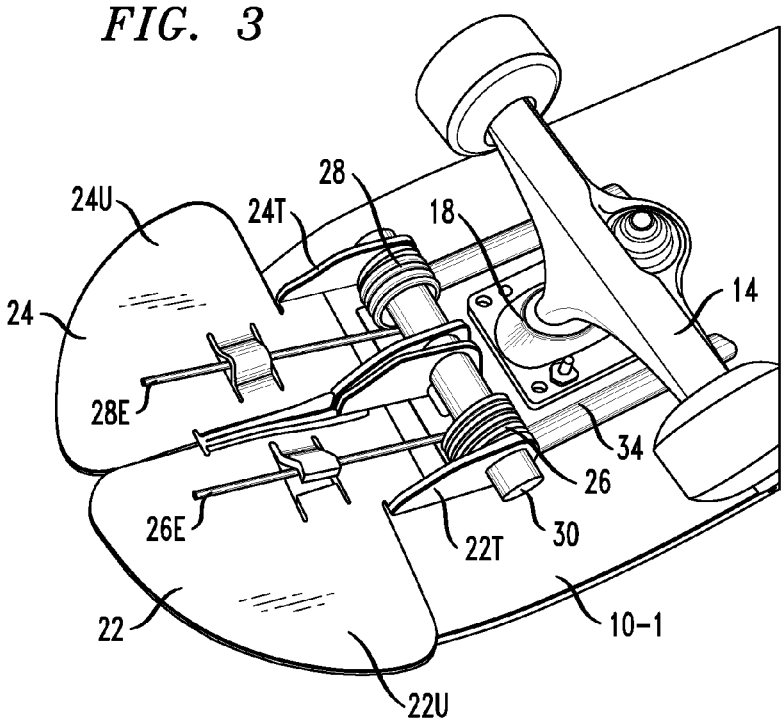
FIG. 3 is a bottom view of the arrangement of FIG. 2.

FIG. 2 is a close-up view of end 10-1 of skateboard 10, clearly illustrating the location and details of spring-loaded ollie accessory 20-1 (for the sake of clarity, this device will thereafter simply be referred to as "ollie accessory 20"). FIG. 3 is a view of the underside of skateboard 10, clearly showing the spring components of ollie accessory 20, as well as the plate used to attach accessory 20 to truck 18 of skateboard 10.

As best shown in FIG. 2, ollie accessory 20 comprises a pair of spring-loaded kick plates 22 and 24 that are mounted onto truck 18 and disposed underneath end portion 10-1 of skateboard 10. When a rider initiates the ollie maneuver, kick plates 22 and 24 contact the ground, compressing their attached springs compress into a tensioned state. End portion 10-1 of skateboard 10 then contacts accessory 20. As the rider adjusts his stance, skateboard 10 will rise off the ground, with the springs attached to the kick plates transferring energy from their compressed state to the board, adding more "lift" to the skateboard movement. This additional lift generated by spring-loaded kick plates 22 and 24 provides more "air" to the maneuver—giving a new rider success in performing this trick. If the spring tension is relatively large, a larger energy transfer occurs—providing even more lift. This additional "air time" gives the seasoned rider the ability to perform more complicated maneuvers before the board returns to the ground.

FIG. 3 is a bottom view of this portion of skateboard 10, clearly illustrating an exemplary attachment of ollie accessory 20 to truck 18 of skateboard 10. In this particular embodiment, spring-loaded kick plate 22 is shown as further comprising a first torsion spring 26 attached to the underside 22U of kick plate 22. Similarly, a second torsion spring 28 is attached to the underside 24U of kick plate 24. Torsion springs 26 and 28 are disposed on a rod 30 extending between adjacent end terminations 22T and 24T of kick plates 22 and 24, respectively. As shown, an extended end 28E of spring 28 is attached to kick plate 24 (for example, by passing end 28E through a channel formed in the kick plate). Similarly, an extended end 26E of spring 26 is attached to kick plate 22.

Figure 4:
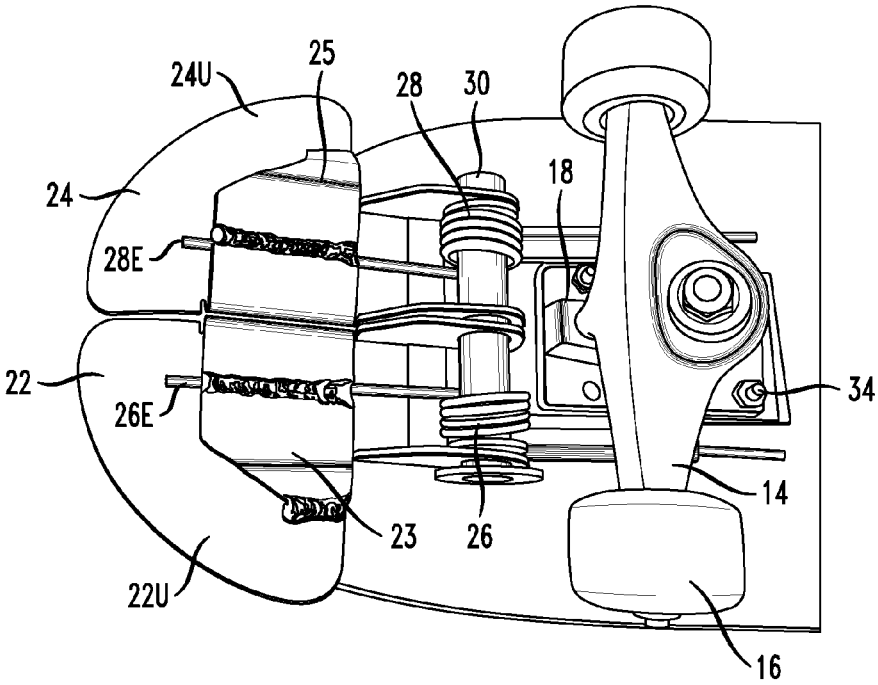
FIG. 4 is a bottom view of an alternative configuration of the embodiment of FIG. 3, in this case including cover plates over the exposed ends of the springs.

While extended ends 26E and 28E remain exposed in this view of FIG. 3, it is also possible to enclose these end terminations with a covering material (which may also add an additional degree of ruggedness to the arrangement by preventing the springs from becoming dis-engaged from the kick plates). FIG. 4 illustrates a specific arrangement of the embodiment as shown in FIG. 3, where in this coverplates 23 and 25 are included and used to enclose the ends of springs 26 and 28, respectively. layer (such as another piece of metal) to enclose extended ends 26E and 28E, shown as coverplates 23 and 25 in FIG. 3.

In accordance with this embodiment of the present invention, the incorporation of springs 26, 28 with rotatable kick plates 22 and 24 provides the desired spring-loaded action that creates additional lift as the skateboard becomes airborne during an ollie maneuver. Referring again to FIGS. 3 and 4, a terminating portion 32 of ollie accessory 20 (also referred to as a "mounting plate 32") is shown as extending under baseplate 34 of truck 18. Terminating portion (mounting plate) 32 includes openings (not shown) that allow for simultaneous attachment of truck 18 and terminating portion 32 to the underside of deck 12. While terminating portion 32 is shown in this example as positioned directly in contact with the underside of deck 12, other embodiments are possible. For example, ollie accessory 20 may be attached in a manner where a gap remains between the deck and the accessory (i.e., closer to the hanger and the wheels). Obviously, the positioning of spring-loaded ollie accessory 20 with respect to the deck will control the amount of spring-action lift that accessory 20 adds to the operation of the ollie maneuver.

Figure 5:
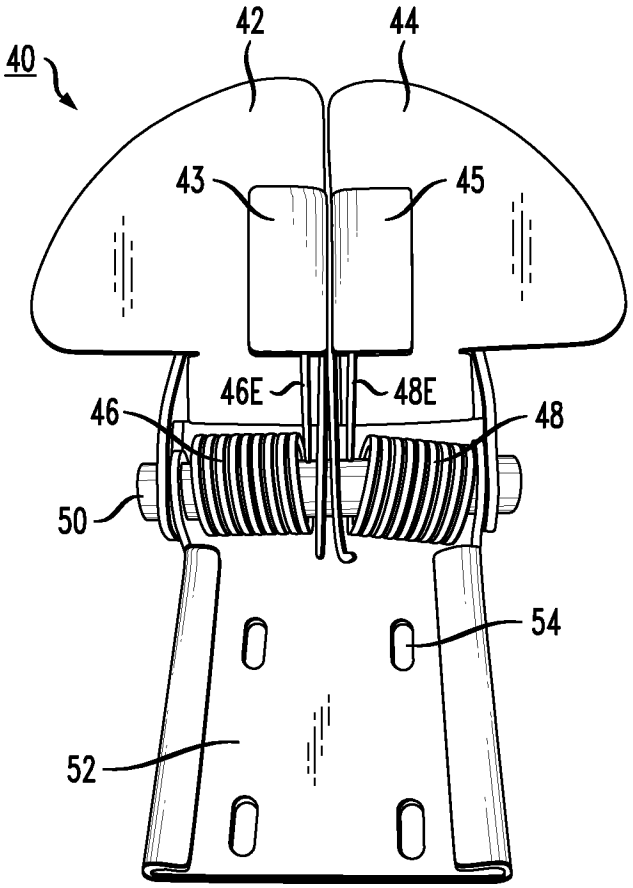
FIG. 5 illustrates another embodiment of a spring-loaded ollie accessory formed in accordance with the present invention, in this case including a large, heavy spring for additional "lift"

FIG. 5 illustrates an alternative ollie accessory 40 formed in accordance with the present invention, in this case shown separately from a skateboard. As mentioned above, the inventive ollie accessory may be sold separately from the skateboard, with the user attaching the accessory during the same process as attaching a truck to a deck.

As shown in FIG. 5, ollie accessory 40 includes a pair of spring-loaded kick plates 42, 44. Kick plate 42 is shown as including a torsion spring 46 and kick plate 44 is shown as including a torsion spring 48, the springs passing through a rod 50. In comparing this embodiment to that of FIG. 3, springs 46, 48 are shown to be larger and heavier and, therefore, provide a larger spring action to the ollie maneuver. Accessory 40 may be considered to be best suited for use by a skilled rider who wants to achieve more "lift", where accessory 20 may be considered to be best suited for use as a training device by a new rider. Continuing with the description of ollie accessory 40 as shown in FIG. 5, it is shown that end portions 46E and 48E of springs 46 and 48 are kick plates 42 and 44, respectively. As with the arrangement shown in FIG. 4, the terminations of end portions 46 and 48 of ollie accessory 40 are shown in this view as fully enclosed within coverplates 43 and 45 that are attached to kick plates 42 and 44.

Figure 6:
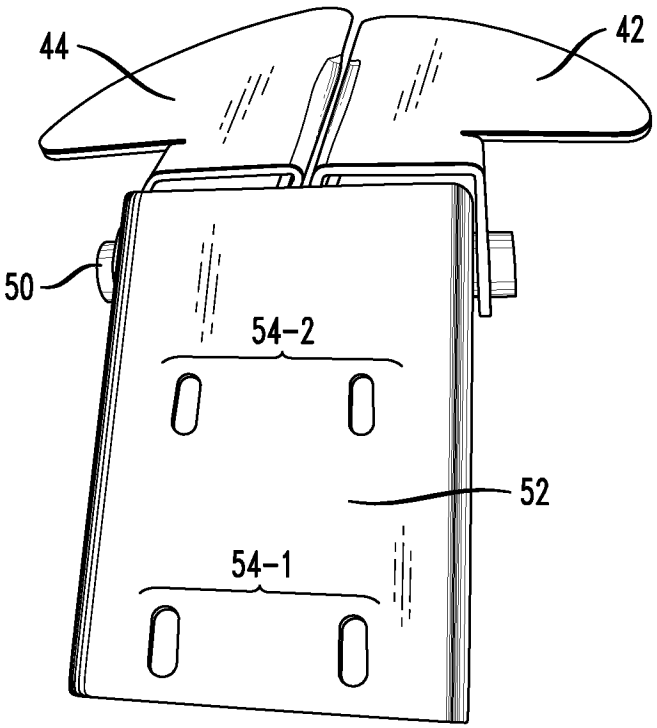
FIG. 6 is a view of the top side of the accessory of FIG. 5, showing a set of attachment slots for use in coupling the accessory to a skateboard.

As also shown in FIG. 5, accessory 40 includes a terminating portion 52, including a number of slots 54. Slots 54 are used to provide attachment of accessory 40 to a skateboard truck (and, ultimately, the deck). FIG. 6 is a top view of ollie accessory 40, clearly illustrating terminating portion 52 and slots 54. In this particular embodiment, slots 54 take the form of a first pair of slots 54-1 and a second pair of slots 54-2. In this case, therefore, accessory 40 can be attached to a skateboard truck (not shown) using either pair 54-1 or 54-2, depending on the size of the board, the desired amount of extra spring action, or for any other reason. It is to be understood that different embodiments of the spring-loaded ollie accessory of the present invention may use more slots, or fewer slots, depending on the type of board to which the accessory is to be attached. Indeed, while the ollie accessory of the present invention can be used as an "after market"

attachment, it is also possible to fabricate a skateboard in the first instance to include the spring-loaded ollie accessory of the present invention.

Figure 7:
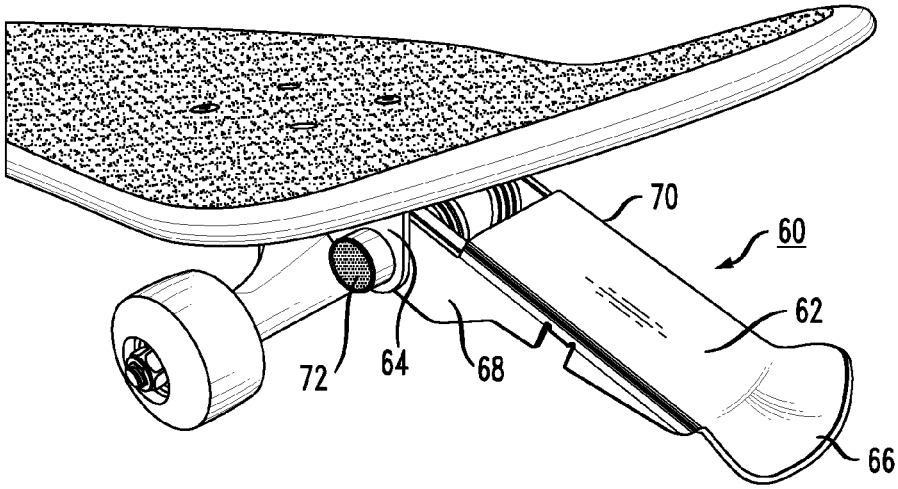
FIG. 7 is an isometric view of a portion of a skateboard equipped with yet another embodiment of the present invention, in this case comprising a single kick plate.
Figure 8:
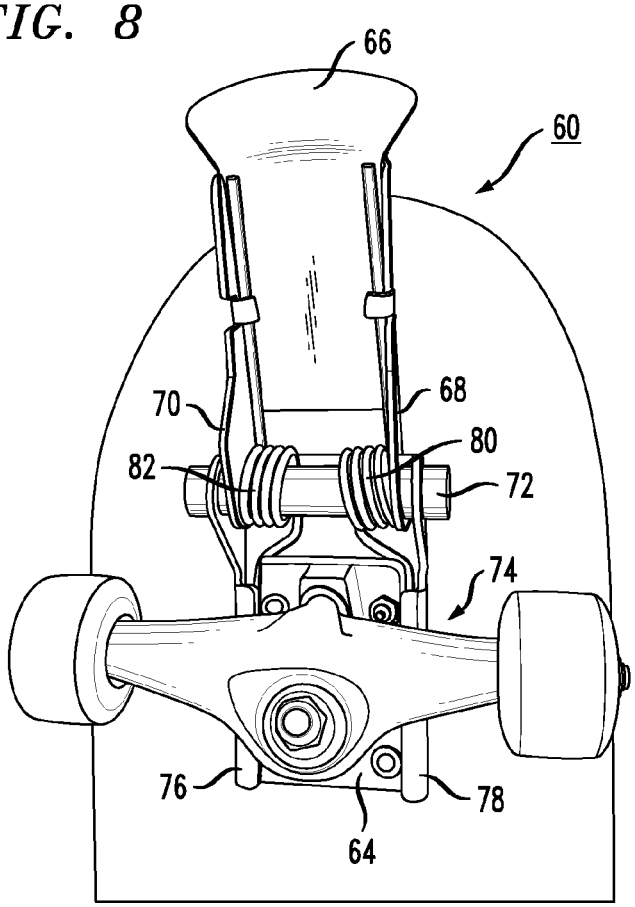
FIG. 8 is a bottom view of the embodiment of FIG. 7.

While the embodiments as described above illustrate the utilization of a pair of adjacent kick plates, it is to be understood that an ollie accessory of the present invention may also be formed as a single kick plate attached to the underside of a board. FIG. 7 is an isometric view of a portion of a skateboard including an exemplary ollie accessory 60 that comprises a single spring-loaded kick plate 62 attached to an exemplary skateboard truck 64. FIG. 8 is a bottom view of ollie accessory 60, clearly showing its attaching to truck 64. Referencing both FIGS. 7 and 8, kick plate 62 is shown as including a flap end region 66 and a pair of side arms 68, 70. Side arms 68 and 70 are perpendicular to flap 66, where each arm includes an aperture at its end, with a rod 72 passing through the apertures of arms 68, 70. As evident in the view of FIG. 7, flap 66 is somewhat curved. The degree of curvature (or, alternatively, the lack of curvature) is considered to be a design detail and any type of kick plate curvature is considered to fall within the spirit and scope of the present invention. It is contemplated that the curvature (for example, inward toward the deck) allows for better control of the lift of the skateboard during an ollie maneuver.

As best shown in FIG. 8, a terminating portion 74 of accessory 60 is shown as including a pair of channels 76, 78 that engage with and attach to truck 64. This type of channel engagement is considered to be an alternative to using a plurality of slots formed within the terminating portion to attach the accessory to the truck. Indeed, various other arrangements (including combinations of different arrangements) for attaching the accessory to the truck may be used, and all are contemplated to fall within the scope of the present invention.

In accordance with this embodiment of the present invention, a first torsion spring 80 is disposed on rod 72 and attached to arm 68. Similarly, a second torsion spring 82 is disposed on rod 72 and, in this case, is attached to arm 70. As with the embodiments described above, springs 80 and 82 will compress as accessory 60 contacts the ground during an ollie maneuver. When the board is released, the spring compression will be transferred into additional lift energy for the board.

Figure 9:
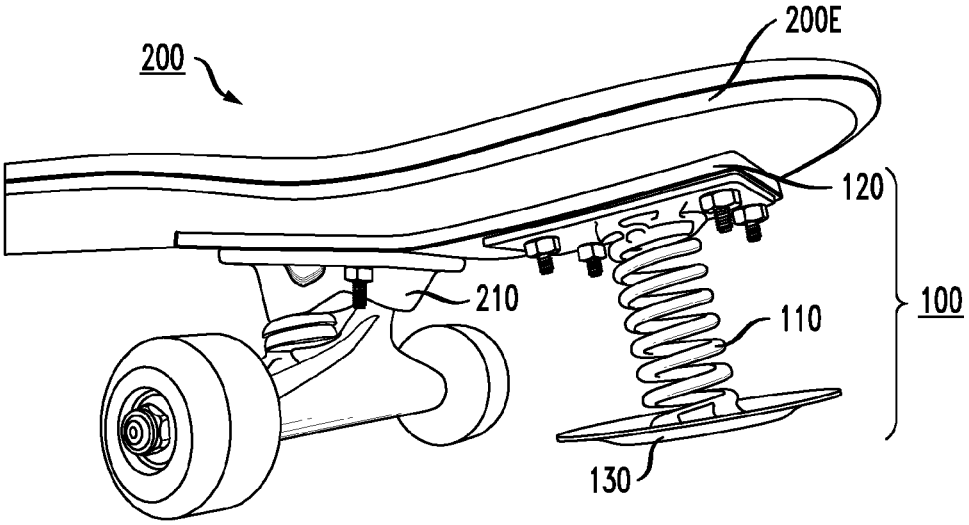
FIG. 9 is a side view of yet another embodiment of the present invention, in this case utilizing a conventional spring, disposed vertically between the skateboard and the kick plate.

While the arrangements as described above utilize one or more torsion springs to impart lift for the spring-loaded ollie accessory, various other types of springs may be used with various other embodiments of the present invention. Indeed, FIG. 9 illustrates an exemplary spring-loaded ollie accessory 100 that utilizes a conventional vertical spring 110. As shown, ollie accessory 100 includes vertical spring 110 coupled between an attachment fixture 120 and a kick plate 130. In this case, kick plate 130 comprises a relatively flat, round member that is disposed underneath an end portion 200E of a skateboard 200. Attachment fixture 120 attaches to a truck 210 of skateboard 200 in any suitable manner, such as any of the particular configurations described above.

Figure 10:
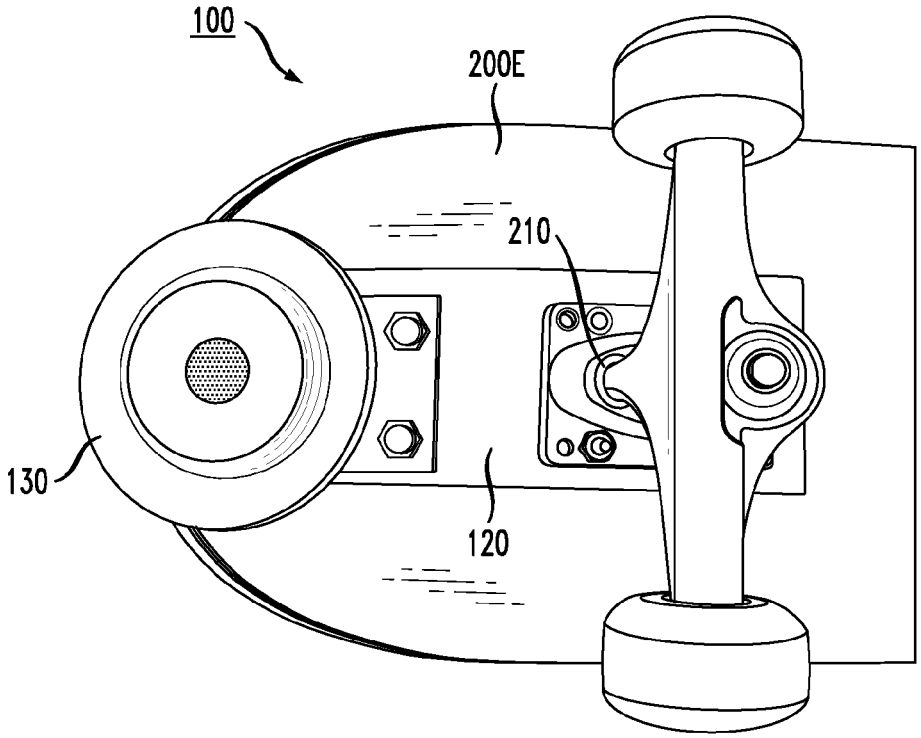
FIG. 10 is a bottom view of the embodiment of FIG. 9.

FIG. 10 is a bottom view of end portion 200E of skateboard 200, clearly showing in this view the shape and design of kick plate 130 (vertical spring 110 is hidden in this particular view). Attachment fixture 120 is shown as being disposed between the underside of skateboard 200 and truck 210, with the mounting hardware used to attach truck 210 also used to attach ollie accessory 100.

In use, when a rider forces end portion 200E of skateboard 200 toward the ground, kick plate 130 will touch the ground before end portion 200E, forcing vertical spring 110 to compress. Therefore, similar to the embodiments described above, when the rider releases the pressure from end portion 200E, the energy in the compressed spring will be transferred into "lift" of the board.

Figure 11:
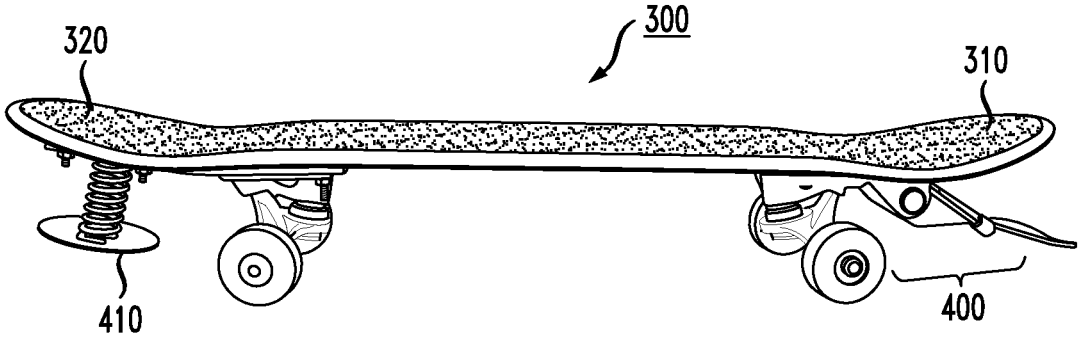
FIG. 11 is a side view of a conventional skateboard that has been equipped with a pair of different spring-loaded ollie accessories—one accessory based upon a torsion spring-loaded kick plate and another accessory using a vertical spring connected to a round kick plate.

It is to be understood that is also possible to configure a skateboard to include various, different configurations of ollie accessories at either end of a board. FIG. 11 illustrates an exemplary arrangement of this configuration. As shown, a skateboard 300 is modified to include a two-piece kick plate spring-loaded ollie accessory 400 (perhaps similar to accessories 20 or 40 described above) at a first end 310 of skateboard 300. Additionally, a vertical spring ollie accessory 410 (perhaps similar to accessory 100 described above) is shown as attached to the opposite end of skateboard 300 (defined as second end 320). In one exemplary embodiment of the present invention, the ollie accessory is formed of a metal such as aluminum. Other materials may be used (including, possibly, plastics) and the specific material is not considered to be part of the invention. An additional advantage of the present invention is that the inclusion of the ollie accessory helps protect the end portion of the deck from becoming damaged during use, since the kick plate will contact the ground and absorb most of the shock before the deck hits the ground. A cover (not shown) may also be used to protect the kick plates from damage.

Additionally, an embodiment of the present invention may be formed to utilize adjustable springs, thus allowing for the tension to be controlled by the user to provide a personally preferred amount of lift.

Although not specifically shown in the drawings, it is to be understood that the kick plate of the present invention may be installed on the front end portion of the board or, alternatively a pair of kick plates may be installed, one coupled to the back end portion and a separate one coupled to the front end portion. Moreover, while the arrangements as shown in the drawings illustrate the kick plate as being attached somewhere along the truck, it is contemplated that the kick plate mechanism may be clamped to the end of the deck itself (so as to surround the end, for example) or, alternatively, include a "sleeve" component that fits over the deck and is fixed in place to attach the kick plate to the skateboard.

Indeed, various other arrangements for attaching a kick plate may be contemplated and are considered to fall within the scope of the present invention.

What is claimed is:

1. A spring-loaded skateboard accessory comprising a mounting plate for attaching the accessory to a skateboard truck;

a rotatable kick plate assembly; and a spring component coupled between the mounting plate and the rotatable kick plate, the spring component disposed to compress as the kick plate assembly contacts the ground and thereafter release energy to provide lift to a skateboard maneuver as the kick plate raises off of the ground.

2. A spring-loaded skateboard accessory as defined in claim 1 wherein the spring component comprises a pair of torsion springs and a central rod member disposed therethrough, with the rotatable kick plate assembly coupled to the central rod in a manner that allows for movement of the kick plate assembly with respect to the skateboard truck.

3. A spring-loaded skateboard accessory as defined in claim 2 wherein the rotatable kick plate assembly comprises a single kick plate coupled to both torsion springs of the pair of torsion springs.

4. A spring-loaded skateboard accessory as defined in claim 3 wherein the single kick plate includes a pair of side arms, with each torsion spring attached to a separate side arm of the pair of side arms.

5. A spring-loaded skateboard accessory as defined in claim 3 wherein the single kick plate includes a curved end region.

6. A spring-loaded skateboard accessory as defined in claim 2 wherein the rotatable kick plate assembly comprises a pair of kick plates, each kick plate attached to separate torsion spring of the pair of torsion springs.

7. A spring-loaded skateboard accessory as defined in claim 1 wherein the spring component comprises a vertical spring coupled between the mounting plate and the kick plate assembly.

8. A spring-loaded skateboard accessory as defined in claim 1 wherein the spring component exhibits an adjustable spring tension.

9. A spring-loaded skateboard accessory as defined in claim 1 wherein the mounting plate includes a plurality of slots for providing attachment to skateboard truck hardware.

10. A spring-loaded skateboard accessory as defined in claim 9 wherein the plurality of slots are formed as separate pairs of slots for adjusting the position of the spring-loaded skateboard accessory with respect to an end termination of a skateboard.

11. A spring-loaded skateboard accessory as defined in claim 1 wherein the mounting plate includes a pair of side channels for engaging side terminations of a skateboard truck and providing attachment thereto.

12. A skateboard including a skateboard deck including an upper surface on which a rider takes position and a lower surface upon which additional elements are attached;

a pair of skateboard trucks attached to the lower surface of the skateboard deck in a spaced-apart configuration, each truck including an axle with wheels mounted on either end of the axle; and at least one spring-loaded accessory comprising a mounting plate for attaching the accessory to a skateboard truck of the pair of skateboard trucks;

a rotatable kick plate assembly; and a spring component coupled between the mounting plate and the rotatable kick plate, the spring component disposed to compress as the kick plate assembly contacts the ground and thereafter release energy to provide lift to a skateboard maneuver as the skateboard raises off of the ground.

13. A skateboard as defined in claim 12 wherein the skateboard includes a pair of spring-loaded skateboard accessories, with a separate spring-loaded accessory attached to a separate truck of the pair of skateboard trucks.

14. A skateboard as defined in claim 12 wherein the skateboard includes a single spring-loaded skateboard accessory, attached to a selected skateboard truck of the pair of skateboard trucks.

* * * * *